US009650747B2

(12) United States Patent
Villwock et al.

(10) Patent No.: US 9,650,747 B2
(45) Date of Patent: May 16, 2017

(54) DEVICE AND PROCEDURE TO DETERMINE A SIZE OF CONTACT REPRESENTING THE CONTACT STATE OF A COMPACTOR ROLLER UPON THE SUBSTRATE TO BE COMPACTED

(71) Applicant: HAMM AG, Tirschenreuth (DE)

(72) Inventors: Sebastian Villwock, Pechbrunn (DE); Werner Völkel, Neustadt (DE); Fritz Kopf, Vienna (AT)

(73) Assignee: HAMM AG, Tirschenreuth (DE)

( * ) Notice: Subject to any disclaimer, the term of this patent is extended or adjusted under 35 U.S.C. 154(b) by 225 days.

(21) Appl. No.: 14/515,845

(22) Filed: Oct. 16, 2014

(65) Prior Publication Data

US 2015/0101424 A1 Apr. 16, 2015

(30) Foreign Application Priority Data

Oct. 16, 2013 (DE) ..... 10 2013 220 962

(51) Int. Cl.

| | |
|---|---|
| ***E01C 19/23*** | (2006.01) |
| ***E02D 3/026*** | (2006.01) |
| ***E01C 19/26*** | (2006.01) |
| ***E02D 3/039*** | (2006.01) |

(52) U.S. Cl.

CPC ..... *E01C 19/236* (2013.01); *E01C 19/26* (2013.01); *E02D 3/0265* (2013.01); *E02D 3/039* (2013.01)

(58) Field of Classification Search

CPC ..... E01C 19/236; E01C 19/26; E02D 3/0265; E02D 3/039

See application file for complete search history.

(56) References Cited

U.S. PATENT DOCUMENTS

| | | | | |
|---|---|---|---|---|
| 5,821,433 | A * | 10/1998 | Goldman | G01L 5/0085 73/862.55 |
| 7,392,715 | B2 * | 7/2008 | Moore | G01L 5/0085 73/862.55 |
| 9,157,184 | B2 * | 10/2015 | Cantrell | D21F 3/04 |
| 2005/0183512 | A1 | 8/2005 | Corcoran | |
| 2010/0071480 | A1 * | 3/2010 | Pietikainen | G01L 5/045 73/862.55 |

(Continued)

FOREIGN PATENT DOCUMENTS

| | | | |
|---|---|---|---|
| CN | 204174508 | U | 9/1996 |
| CN | 1182464 | A | 5/1998 |

(Continued)

OTHER PUBLICATIONS

Search Report and Office Action issued for Chinese Patent Application No. 201410545564.3 dated Mar. 28, 2016 (6 pages).

(Continued)

*Primary Examiner* — Ryan Walsh

(74) *Attorney, Agent, or Firm* — Rothwell, Figg, Ernst & Manbeck, P.C.

(57) ABSTRACT

Device to determine a size of contact representing a contact state between a compactor roller and a substrate to be compacted, encompassing a compactor roller rotatable in at least one acquisition circumference area around a compactor roller axis and at least one contact sensor generating a contact signal, wherein the contact signal indicates a contact start and a contact end of an acquisition circumference area upon the substrate to be compacted.

24 Claims, 3 Drawing Sheets

(56) References Cited

U.S. PATENT DOCUMENTS

Figure 1:
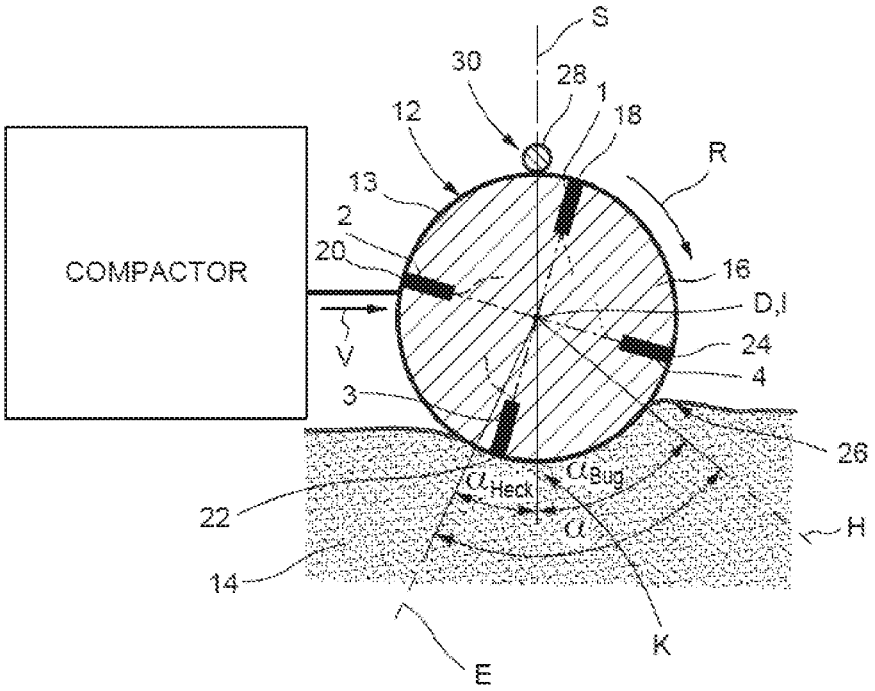

| | | | | |
|---|---|---|---|---|
| 2012/0180573 | A1* | 7/2012 | McNamee | G01L 1/16 73/862.68 |
| 2012/0310596 | A1* | 12/2012 | Gustafson | D21F 3/06 702/170 |
| 2014/0341650 | A1 | 11/2014 | Villwock et al. | |
| 2016/0076955 | A1* | 3/2016 | Miyajima | B65G 43/02 73/862.046 |

FOREIGN PATENT DOCUMENTS

| | | | |
|---|---|---|---|
| CN | 102587264 | A | 7/2012 |
| DE | 2551305 | A1 | 5/1976 |
| DE | 102005000641 | A1 | 9/2005 |
| DE | 102011088567 | A1 | 6/2013 |
| WO | 9627713 | A1 | 9/1996 |
| WO | 2013087783 | A1 | 6/2013 |

OTHER PUBLICATIONS

European Search Report issued for European Patent Application No. 14 18 5929 dated Mar. 10, 2015 with machine English translation, 8 pages.

German Search Report issued for German Patent Application No. 1020132209622 dated Jul. 11, 2014, with machine English translation, 13 pages.

* cited by examiner $$b = \sqrt{\frac{8 \cdot (1 - \nu^2) \cdot F \cdot r}{\pi \cdot E \cdot l}}$$

DEVICE AND PROCEDURE TO DETERMINE A SIZE OF CONTACT REPRESENTING THE CONTACT STATE OF A COMPACTOR ROLLER UPON THE SUBSTRATE TO BE COMPACTED

CROSS REFERENCE TO RELATED APPLICATION(S)

This application claims priority to German Application No. 10 2013 220 962.2, filed Oct. 16, 2013. The entirety of the disclosure of the above-referenced application is incorporated herein by reference.

BACKGROUND OF THE INVENTION

Field of the Invention

The invention relates to a device as well as a procedure to determine a size of contact representing the contact state of a compactor roller upon the substrate to be compacted.

Background of Related Art

In order to compact a substrate, for example soil, various types of stone or also asphalt in road construction, self-propelled earth compactors are generally used which drive over the substrate to be compacted with one or several compactor rollers and by means of pressure loading, if applicable in conjunction with oscillation or vibration movements, resulting in a compacting of the construction material of the substrate to be compacted. Because of the pressure loading applied to the substrate a compactor roller basically more rigid in general in comparison to the substrate to be compacted will produce a settlement depression in the substrate to be compacted. The more rigid or already more compact such a substrate is, the less deep a compactor roller will be depressed into the construction material of the substrate, with the result that with increasing rigidity or increasing scale of the compacting, a contact width of the compactor roller on the substrate to be compacted decreases.

SUMMARY OF THE INVENTION

It is the object of this invention to provide a device and a procedure to determine a size of contact representing the contact state of a compactor roller upon the substrate to be compacted which permits in a simple and reliable manner a modification of the compaction state of the construction material of the substrate to be compacted.

According to a first aspect of this invention this object is achieved by a device to determine a size of contact representing a contact state between a compactor roller and a substrate to be compacted, encompassing a compactor roller rotatable in at least one acquisition circumference area around a compactor roller axis and at least one contact sensor generating a contact signal, wherein the contact signal indicates a contact start and a contact end of an acquisition circumference area upon the substrate to be compacted.

By means of the inventively constructed device, information is made available which represents, for example, that portion in relation to an entire revolution of the compactor roller in association with the acquisition circumference area, in which an acquisition circumference area is in contact with the substrate to be compacted. The larger this portion is and also the greater the separation between the start of contact and the end of contact is, the larger the scale of the contact between the compactor roller and the substrate to be compacted, which indicates that the compactor roller penetrates comparatively deeply into the material of the substrate to be compacted and that this material therefore is comparatively little compacted. With an increasing degree of compaction the compactor roller penetrates less deeply into the construction material of the substrate to be compacted which means that, again in relation to an entire revolution or the entire circumference of the compactor roller, that portion in which contact exists with the substrate to be compacted decreases. The size of contact to be determined with the inventive device thus allows an inference about the degree of compaction of the substrate to be compacted and can thus also be used to determine additional compaction and processing measures on the substrate to be compacted.

In order to be able to determine the size of contact more accurately or more frequently during the course of the compactor roller movement, it is recommended that a majority of the acquisition circumference area be provided with at least one contact sensor preferably distributed around the compactor roller axis in an equal axial area. It is thereby especially advantageous, when the acquisition circumference areas are positioned with respect to each other at a basically equal circumferential separation, preferably about 90°. By means an equal separation of the acquisition circumference areas, a periodic acquisition pattern of the various acquisition circumference areas can be made available with a defined time offset and be used for evaluation.

An adverse effect on the contact sensors during the compaction operation can be avoided in that in at least one, preferably in each, acquisition circumference area at least one contact sensor is provided on the inside of the roller covering of the compactor roller. For example, such a contact sensor can be constructed as:

- an acoustic sensor, preferably an ultrasound sensor or whistle sensor, or
- a contact sensor, or
- a pressure sensor.

These are sensors with a comparatively simple construction which reliably allow an inference about whether that area in which a contact sensor is positioned, namely a respective acquisition circumference area, is in contact with the substrate to be compacted or not.

In order to obtain a detailed evaluation of a signal supplied by a contact sensor, the invention further provides for a rotation position acquisition arrangement to acquire a rotation position of the compactor roller. The provision of information about the rotation position of the compactor roller in relation to that of a contact signal provided by a contact sensor can be used in an especially advantageous manner to obtain information about an asymmetrical contact behavior of the compactor roller upon the substrate to be compacted, in particular about the origin of a bow-wave generated created by the forward movement of the compactor roller in the substrate to be compacted.

In this regard, for example, the rotation position acquisition arrangement can encompass at least one contact sensor and at least rotation position referencing area which is rotatable around the compactor roller axis and interacts with the at least one contact sensor and not with the compactor roller.

Since this invention uses the rotation of the compactor roller around its compactor roller rotation axis to determine—during the course of such a rotation movement—information about beginning contact or ending contact of a respective acquisition circumference area, according to one especially advantageous variant the size of contact can represent a circumference area of the compactor roller standing in contact with the substrate to be compacted. This circumference area can be represented by a length segment, namely for example a circumference length segment, or an angular segment.

According to another aspect of this invention the stated object is achieved by a procedure to determine a size of contact representing a contact state of a compactor roller upon a substrate to be compacted, preferably by means of a device constructed according to the invention, encompassing the acquisition of a contact between at least one acquisition circumference area of the compactor roller and the substrate to be compacted during the rotation of the compactor roller around a compactor roller axis.

Even in the inventive procedure the contact between the compactor roller and the substrate to be compacted or the size of contact representing this contact is determined based on the start of contact, which appears in the course of rotation of the compactor roller between at least one acquisition circumference area and the substrate to be compacted, and the end of contact. In the time between the start of contact and the end of contact, one respective acquisition circumference area is in contact with the substrate to be compacted, while after the end of contact until the following start of contact, the acquisition circumference area is not in contact with the substrate to be compacted.

To be able to determine in a simple manner—based on the start of contact and the end of contact, or the time duration therebetween—a geometric value representing the contact state, the invention proposes that the size of contact is further determined based on a movement speed of the compactor roller and/or a radius of the compactor roller.

In one variant of the inventive procedure functioning in particular with only a single contact sensor, the size of contact can be determined based on a relationship between a first movement time indicating a contact of at least one acquisition circumference area with the substrate to be compacted, and a second movement time indicating no contact during the course of a revolution of the compactor roller around the compactor roller axis and/or a second movement time indicating a revolution of the compactor roller. In this manner the time during which a respective acquisition circumference area moves in contact with the substrate to be compacted is also placed in a relationship to that time in which such contact does not exist or in relation to the time of the entire revolution of the compactor roller. Both possibilities simply yield information as to which angular part of the compactor roller actually is in contact with the substrate to be compacted, which, as stated, allows an inference about how deep the compactor roller penetrates into the material to be compacted.

Even the bow-wave originating during the forward movement of an earth compactor or a compactor roller of an earth compactor, namely the accumulation of material to be compacted arising in the movement direction of an earth compactor in front of the compactor roller, allows an inference about the condition of the substrate to be compacted. The origination of such a bow-wave basically shows that the contact of a compactor roller with the substrate being compacted is asymmetrical, since such a bow-wave or accumulation of material of the substrate to be compacted does not occur to that extent in the area lying behind the same in the direction of movement of the compactor roller. This invention uses that aspect such that the size of contact is composed of a first contact portion between the start of contact of a least one acquisition circumference area with the substrate to be compacted and a contact reference position, and a second contact size component between the contact reference position and the end of contact.

This contact reference position, for example, can represent a deepest positioning of the acquisition circumference area in the course of the circumferential movement of the acquisition circumference area, in relation to a vertical line positioned essentially orthogonal to the substrate to be compacted, wherein the first contact portion is a bow-side part of the contact portion and the second contact portion is a rear-side part of the contact portion. With a basically horizontally oriented substrate to be compacted and a corresponding horizontally moving compactor roller, such a contact reference position can also encompass a contact area lying in a vertical direction essentially directly below the rotation axis of the compactor roller. The previous portion in the direction of movement is viewed as the bow-side and will in general exhibit a larger dimension than the following rear-side portion because of the presence of the previously mentioned bow-wave.

In order to obtain information in the inventive procedure regarding the rotation positioning of the compactor roller or a respective acquisition circumference area, it is recommended that the contact reference position be determined based on at least one rotation positioning reference. Such a rotation positioning reference, for example, can be generated by the interplay of at least one acquisition circumference area with a rotation positioning reference area.

With the use of several acquisition circumference areas one can advantageously proceed so that the first acquisition circumference area basically generates a rotation positioning reference by interplay with a rotation positioning reference area, if a second acquisition circumference area is in the contact reference position.

The size of contact which can be determined with the inventive procedure can represent a circumference area of the compactor roller standing in contact with the substrate to be compacted. From this circumference area a contact size of the compactor roller on a substrate to be compacted can be determined, for example, by means of an orthogonal projection onto a plane fixed by the substrate to be compacted, which in turn can be used to determine information about various physical values, like for example the elasticity modulus or Poisson's ratio of the substrate to be compacted by means of mathematical operations.

BRIEF DESCRIPTION OF THE DRAWING FIGURES

Figure 2:
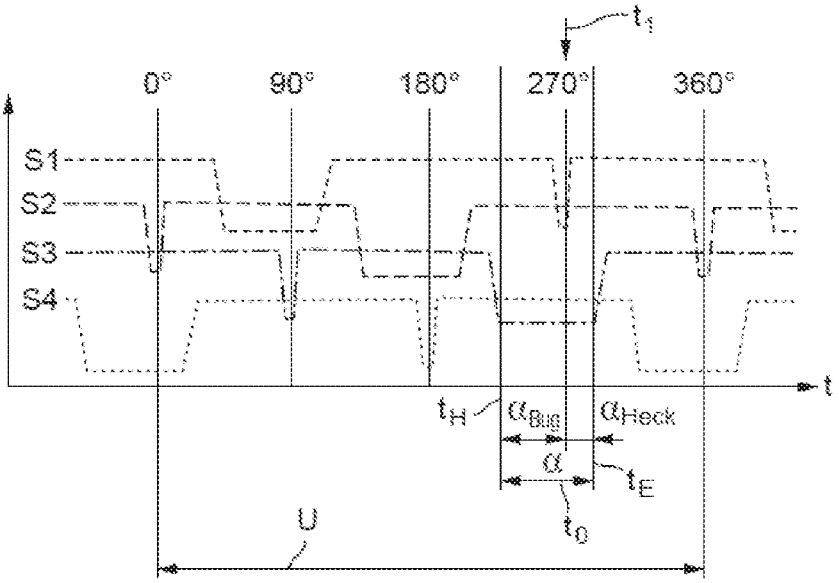
Figures 3, 4:
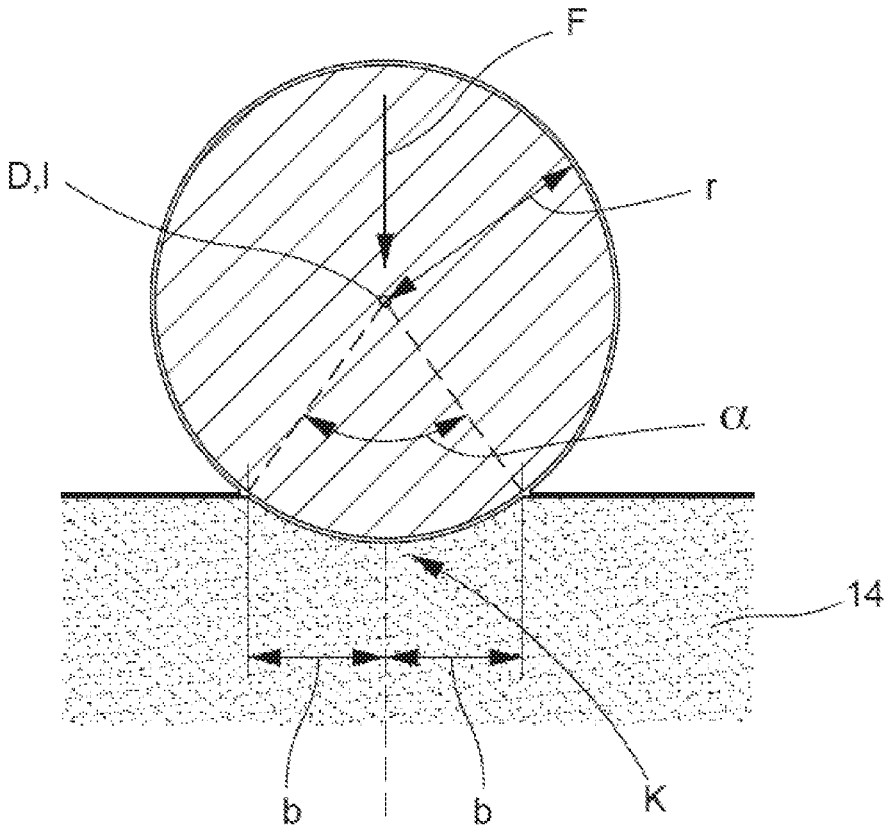
Figure 5:
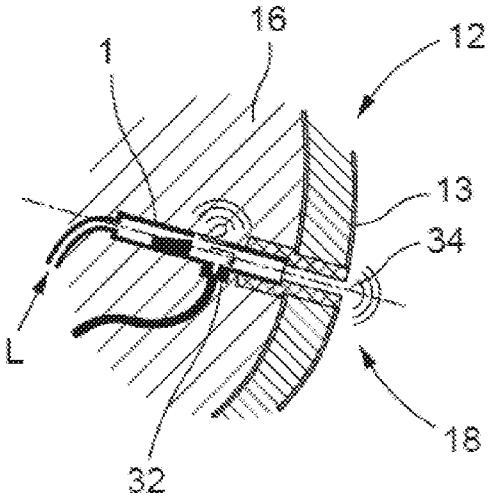
Figure 6:
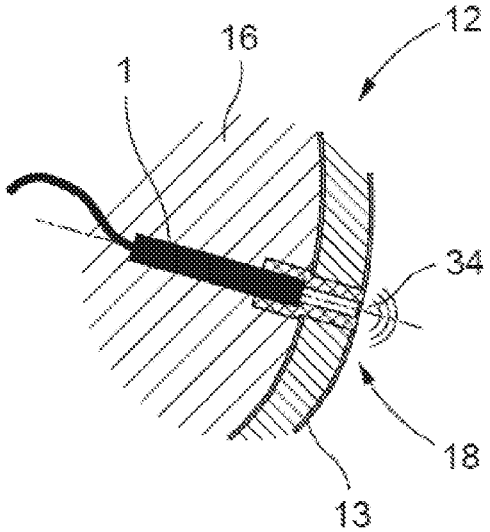
Figure 7:
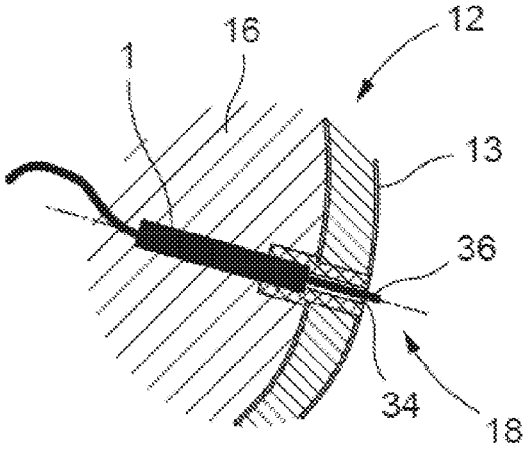
Figure 8:
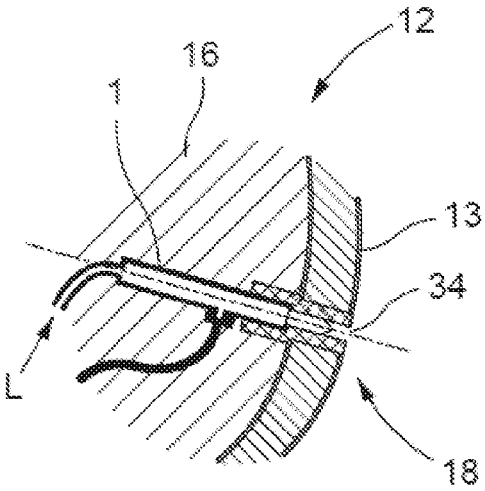

The invention will next be described in detail referencing the attached drawings. Shown are:

FIG. 1: A principle depiction of a compactor roller on a substrate to be compacted during the movement of the compactor roller on the substrate;

FIG. 2: A timing diagram which depicts contact signals provided by four contact sensors located in the compactor roller of FIG. 1;

FIG. 3: Simplified determination of a size of contact of a compactor roller on a substrate to be compacted;

FIG. 4: Hertz formula which describes the relationship between a contact width and the material rigidity of material to be compacted;

FIG. 5: A principle depiction of a contact sensor provided on the inside of a roller cover of a compactor roller and constructed in the form of a whistle sensor;

FIG. 6: A depiction corresponding to FIG. 5 of a contact sensor constructed as an ultrasound sensor;

FIG. 7: A depiction corresponding to FIG. 5 of a contact sensor constructed as a tactile sensor;

FIG. 8: A depiction corresponding to FIG. 5 of a contact sensor constructed as a pressure sensor.

DETAILED DESCRIPTION OF THE PREFERRED EMBODIMENTS

FIG. 1 shows in a principle side and cross-section view with reference to a compactor roller axis D, a general device designated by reference number 10 with which a contact size a of a compactor roller 12 on a substrate 14 to be compacted can be determined, as represented in an angular dimension in the example shown. The device 10 encompasses four contact sensors 1, 2, 3, 4 in the interior area 16 enclosed by a roller covering 13 of the compactor roller 12. Contact sensor 1 is thereby positioned in an acquisition circumference area 18 of the compactor roller 12. Contact sensor 2 is positioned in an acquisition circumference area 20. Contact sensor 3 is positioned in an acquisition circumference area 22, while contact sensor 4 is positioned in an acquisition circumference area 24. Each of these contact sensors 1, 2, 3, 4 furnishes a contact signal S1, S2, S3, S4 which varies depending on whether a respective acquisition circumference area 18, 20, 22, 24 in is contact with the construction material of the substrate 14 to be compacted—which in the example shown, is the case only for acquisition circumference area 22 and contact sensor 3—or is not in contact with the construction material of the substrate 14 to be compacted—which in the example shown is the case for acquisition circumference areas 18, 20 and 24 or the contact sensors 1, 2, 4 provided therein FIG. 1 shows in a principle side and cross-section view with reference to a compactor roller axis D, a general device designated by reference number 10 with which a contact size a of a compactor roller 12 on a substrate 14 to be compacted can be determined, as represented in an angular dimension in the example shown. The device 10 encompasses four contact sensors 1, 2, 3, 4 in the interior area 16 enclosed by a roller covering 13 of the compactor roller 12. Contact sensor 1 is thereby positioned in an acquisition circumference area 18 of the compactor roller 12. Contact sensor 2 is positioned in an acquisition circumference area 20. Contact sensor 3 is positioned in an acquisition circumference area 22, while contact sensor 4 is positioned in an acquisition circumference area 24. Each of these contact sensors 1, 2, 3, 4 furnishes a contact signal S1, S2, S3, S4 which varies depending on whether a respective acquisition circumference area 18, 20, 22, 24 in is contact with the construction material of the substrate 14 to be compacted—which in the example shown, is the case only for acquisition circumference area 22 and contact sensor 3—or is not in contact with the construction material of the substrate 14 to be compacted—which in the example shown is the case for acquisition circumference areas 18, 20 and 24 or the contact sensors 1, 2, 4 provided therein.

In the embodiment shown in FIG. 1 the four contact sensors 1, 2, 3, 4 are positioned with respect to each other at the same angular separation of 90°. That means that the contact sensor 1 lies diametrically opposite the contact sensor 3 in relation to compactor roller axis D, while contact sensor 2 lies diametrically opposite the contact sensor 4 in relation to compactor roller axis D.

During movement of one of the earth compactors exhibiting such a compactor roller 12 in the direction V and thus the accompanying rotation of the compactor roller 12 around the compactor roller rotation axis D in the direction R, there occurs in the movement direction V of the compactor roller 12 an accumulation of material generally designated as a bow-wave 26. The contact of the roller cover 13 with the construction material of the substrate 14 to be compacted begins in the area of this bow-wave 26. The area is represented in FIG. 1 by a dashed line A. The contact of the roller cover 13 with the substrate 14 to be compacted ends in an area indicated by a dashed line E. Only in the area between lines A and E, defined here by the angle α, does contact exist between the compactor roller 12 and substrate 14 to be compacted.

A rotation positioning reference area 30 constructed for example as a reference wheel 28 resting on the outer circumference of the roller cover 13 can be used as described in the following manner, in order to generate a rotation positioning reference for the compactor roller 12 in conjunction with the contact sensors 1, 2, 3, 4. Then always when one of these contact sensors 1, 2, 3, 4 moves past a rotation positioning reference area 30, a change indicating this passing movement will appear in contact signal S1, S2, S3, S4 of the respective contact sensor 1, 2, 3, 4, which indicates that at this point in time a contact sensor generating a particular signal has moved past the rotation positioning reference area 30. It should therefore be noted that this rotation positioning reference area 30 must not of necessity be constructed as a reference wheel. Even projections on the compactor roller 12 moving past a proximity switch can be used to determine a respective rotation positioning of the compactor roller 12. The variant shown in FIG. 1 in which the rotation positioning reference can also be produced using contact sensors 1, 2, 3, 4 is especially advantageous because of the simple constructive design which requires no additional sensors.

One further recognizes in FIG. 1 that in the example shown the rotation positioning reference area 30 is positioned in an elevation device directly above the rotation axis D of the compactor roller 12. This means that on a plane fixed by the substrate 14 to be compacted, e.g. a horizontal plane, an orthogonally standing vertical line S on the one side cuts the rotation positioning reference area 30 and on the other side the compactor roller rotation axis D. This vertical line S defines a contact reference position K in the circumferential area lying between lines A and E, namely in that circumferential area in which the compactor roller 12 is in contact with the substrate 14 to be compacted. This contact reference position K divides the angle α defined between both lines A and E into an angle $\alpha_{bow}$ which extends between the line A, namely the start of contact, and the contact reference position K and an angle $\alpha_{rear}$ which extends between the contact reference position K and the line E, namely the end of contact. Because of the circumstance that the bow-wave 26 originates upon the passing movement of the compactor roller 12 in the direction V, the part $\alpha_{bow}$ of the angle α is usually larger than the following part $\alpha_{rear}$. Only in a condition in which such a bow-wave would not be present, would both parts $\alpha_{bow}$ and $\alpha_{rear}$ be basically equal to each other, namely the contact of the compactor roller 12 with the substrate 14 to be compacted is symmetrical with respect to the contact reference position K. It should be noted in this regard, that naturally the compactor roller 12 will exhibit a longitudinal extension I in a longitudinal direction orthogonal to the drawing plane of FIG. 1 and in this respect also the contact reference position K, just like the position defined by the dashed lines A and E, are to be viewed as respective lines which extend basically parallel to the compactor roller rotation axis D of the compactor roller 12.

FIG. 2 shows the time progression of the contact signals S1, S2, S3, S4 generated by the contact sensors 1, 2, 3, 4. These contact signals S1, S2, S3, S4 stand as examples for various signal progressions which indicate respectively whether one of the acquisition circumference areas 18, 20, 22, 24 in question is in contact with the substrate 14 to be compacted or, for example, has moved past the rotation positioning reference area 30 or not. In the example shown, the signal level always decreases when material subtends a respective acquisition circumference area, while the signal level is greater when no material subtends the acquisition circumference area.

The functioning of the device 10 or the manner of determining the size of contact representing the contact between the compactor roller 12 and the substrate 14 to be compacted, for example represented by the angle $\alpha$, is explained below using the contact signals S1 and S3 generated by the contact sensors 1 and 3 in the acquisition circumference areas 18 and 22.

During the course of a complete revolution of the compactor roller 12 represented by the arrow U around the compactor roller rotation axis D, the acquisition circumference area 22 moves with its contact sensor 3 in the area of line A, namely to the point $t_A$ in FIG. 2 in contact with the substrate 14 to be compacted. At this point in time the signal level of the contact signal S3 definitely decreases. That point in time can be selected, for example, as the time for beginning of contact at which the contact signal S3 assumes its minimum value. During further movement the acquisition circumference area 22 moves to the area or to the line E, so that at point in time $t_E$ the acquisition circumference area 22 again moves out of contact with the substrate 14 to be compacted and as a result the signal level again increases. Here the point in time of the increase of the signal level can be taken, for example, as the point in time of the end of contact between the acquisition circumference area 22 and the substrate 14 to be compacted. That means that between the two points in time $t_A$ and $t_E$ the acquisition circumference area 22 was in contact with the material to be compacted. The point in time $t_1$ expresses the condition of FIG. 1.

The circumferential length or the angular area $\alpha$ in which the compactor roller 12 is in contact with the substrate 14 to be compacted, can also be determined in a simple manner by the relationship of the length of the interval $t_0$ between the points in time $t_A$ and $t_E$ to the length of the entire revolution U. By means of this relationship the angle $\alpha$ which represents a fraction or an angular segment of the entire angle of 360° can be determined in a simple manner without further mathematical operations. Under consideration of a radius r of the compactor roller 12 and of the calculated overall circumference of the same, the circumferential length can be determined in which the compactor roller 12 is in contact with the substrate 14 to be compacted. In order to be able to compensate variations in the movement speed in the direction V and the resulting variations in the rotation speed in the rotation direction R, the movement speed and the angular speed can also be taken into consideration in the movement of the compactor roller 12. But under the simplified assumption that during a revolution U of the compactor roller 12 it moves at a basically constant speed, such a speed compensation is not required.

In the manner described above the extent of the contact area between the compactor roller 12 and the substrate can be determined. With additional consideration of the previously addressed contact reference position K, a precise division of the angle $\alpha$, namely the entire circumferential area of the compactor roller 12 in contact with the substrate 14 to be compacted, into two parts $\alpha_{bow}$ and $\alpha_{rear}$ can occur. FIG. 2 shows that between points in time $t_A$ and $t_E$ exactly when the acquisition circumference area 22 moves across the contact reference position K, the acquisition circumference area 18 with its contact sensor 1 moves past the rotation positioning reference area 30. This means that when the acquisition circumference area 22 moves past the contact reference position K, the contact signal S1 of the contact sensor 1 will spontaneously vary, namely for example it will decrease to a lower level. The point in time at which the reduction of the contact signal S1 appears or it is at a minimum level, can be used as the rotation positioning frequency, in order to undertake a division of the interval $t_0$ into the two parts also indicated in FIG. 1, namely the bow-side, advancing, and in a time sense first appearing part $\alpha_{bow}$ and the following part $\alpha_{rear}$ in correlation with the contact signal S3 of the contact sensor 3.

When using the previously described device it is not only possible to determine the circumferential length and the angular segment in which the compactor roller 12 is in contact with the substrate 14 to be compacted, but also an asymmetry of the contact in relation to the contact reference position K can be determined which again allows an inference about the bow-wave 26 forming in front of the compactor roller 12.

It is evident in FIG. 2 that in a corresponding manner even when the acquisition circumference area 18 is in contact with the substrate 14 to be compacted, the movement of the contact sensor 3 past the rotation positioning reference area 30 indicates the contact reference position K has been reached. The same appears in the relationship of the two contact sensors 2 and 4 and the contact signals S2 and S4 generated as a result. This means that in the course of a single revolution U of the compactor roller 12 around its compactor roller rotation axis D, four determinations of the angle $\alpha$ and their portions $\alpha_{bow}$ and $\alpha_{rear}$ occur which facilitate the determination of these values with high precision and a high repetition rate and accordingly also a corresponding frequent consideration of these values during the compaction operations to be performed.

It should be pointed out in this regard that naturally the foregoing can also be used with reference to the operating principle depicted in FIGS. 1 and 2, when a different number of acquisition circumference areas and also another relative positioning of the same is selected. For example, three acquisition circumference areas with an angular separation of 120° can be provided. Work can also be done, for example, with only two acquisition circumference areas which exhibit any desired circumferential separation to each other. Also to be taken into consideration is that when one of the acquisition circumference areas is in the contact reference position K, another acquisition circumference area interacts with the rotation positioning reference area 30 to produce the rotation positioning reference. Also a single acquisition circumference area could lead to the desired result by interaction with a rotation positioning reference area. In this case, however, the movement speed and the angular speed of the compactor roller 12 would also have to be considered in order to determine when an acquisition circumference area moving past the rotation positioning reference area is in the contact reference position. Independent of how many acquisition circumference areas and contact sensors are employed, there is basically the possibility to position the rotation positioning reference area at any desired location in an earth compactor where this is possible or advantageous for construction reasons. Thus for example in the example depicted in FIG. 1, the rotation positioning reference area 30 could be displaced around the compactor roller rotation axis D by 90° to the front or to the rear, so that in correlation with the acquisition circumference area 22 and the contact sensor 3 then the contact signal S4 or S2 of contact sensor 4 or contact sensor 2, could be used, for example.

FIG. 3 illustrates in a simplified example that (or how) in the case of a contact size represented by the angle $\alpha$ a contact width can be determined. In the case shown in FIG. 3 no bow-wave 26 is present so that the two portions $\alpha_{bow}$ and $\alpha_{rear}$ would basically be equal. The circumferential length area represented by the angle $\alpha$ can be converted into the contact width b by an orthogonal projection onto a plane fixed by the substrate 14 to be compacted. In the idealized, symmetrical case shown in FIG. 3 without a bow-wave, the portions $\alpha_{bow}$ and $\alpha_{rear}$ are of equal size and the total angle $\alpha$ corresponds to double the contact width 2*b*. The contact width b can in turn be used in the Hertz formula shown in FIG. 4 under consideration of the known values r, thus the radius of the compactor roller 12, I, thus the length of the compactor roller 12 in the direction of the compactor roller rotation axis D, as well as F, thus the weight force exerted by the compactor roller 12, to obtain an inference about material properties, like the elasticity modulus E or Poisson's ratio v. It should be pointed out that especially in the case of the appearance of a bow-wave and, with regard to the contact reference position K, of an asymmetrical contact of the substrate 14 to be compacted, for the two parts $\alpha_{bow}$ and $\alpha_{rear}$, for example, with the use of a vector decomposition, separate calculations of the contact widths are to be made. There is, however, basically the possibility to determine by tests a correlation between the physical properties of the material to be compacted and the contact relationships thereby occurring, which is represented by the previously described contact sizes, and to archive this relationship, for example, in a table or data bank, so that in the course of a compaction procedure a conclusion can be drawn about the compaction state of the substrate 14 by a comparison of the contact sizes determined using the contact signals with the corresponding values determined in a test.

FIGS. 5 to 8 show different examples of contact sensors which can generally be used in the device 10 depicted in FIG. 1. Thus FIG. 5 shows an acoustic contact sensor 1 known as a whistle sensor which is supplied with air L via an air line 30 which produces a whistle sound in contact sensor 1. This can in turn by received by a microphone 32. The contact sensor 1 is open to the surroundings via an opening 34 in the roller cover 14, so that depending on whether the opening 34 is covered or not, different frequencies of the sound originating in contact sensor 1 can be regulated, whereupon a passing movement of the acquisition circumference area 18, for example, at the rotation positioning reference area 30 or at the substrate 14 to be compacted can be recognized.

FIG. 6 shows the design of the contact sensor 1 as an ultrasound sensor. This generates an ultrasound signal which, depending on whether the acquisition circumference area 18 is covered with material or not, is reflected differently and is received in a corresponding receiver, for example, is also made available in contact sensor 1 with a different level.

FIG. 7 shows a contact sensor 1 constructed as a mechanical tactile sensor. This exhibits a sensing device 36 implemented in an opening 34 in the roller cover 14 so that it is displaced inward when the acquisition circumference area 18 is covered by material. The sensing device 36 can be constructed, for example, as a plunger, so that its displacement into the contact sensor 1 results in the production of an appropriate signal.

FIG. 8 shows a contact sensor 1 constructed as a pressure sensor. Pressurized air L is supplied via a pressurized air line 38. This pressurized air L can escape via an opening 34 in the roller cover 14 and also performs a choke function so long as the opening 34 is not covered. If material lies opposite the acquisition circumference area 18 which hinders or makes difficult the flow of pressurized air L via the opening 34, that fact is acquired by a pressure sensor provided in the contact sensor 1.

It should be pointed out that also the contact sensors 2 to 4 can naturally be constructed in a corresponding manner. It should be mentioned here, too, that contact sensors of a different construction can be combined in the device 10.

The invention claimed is:

1. A self-propelled compactor comprising:

a device to determine a size of contact representing a contact state between a compactor roller and a substrate to be compacted by the compactor, the device comprising:

the compactor roller, which is coupled to the compactor and rotatable in at least one acquisition circumference area around a compactor roller axis upon movement of the compactor in a direction; and at least one contact sensor generating a contact signal, wherein the contact signal indicates a contact start and a contact end of an acquisition circumference area upon the substrate to be compacted.

2. The compactor according to claim 1, wherein a plurality of acquisition circumference areas is provided with respectively at least one contact sensor preferably distributed around the compactor roller rotation axis in the same axial area of the compactor roller.

3. The compactor according to claim 2, wherein the acquisition circumference areas are positioned with respect to each other with an equal circumferential separation.

4. The compactor according to claim 2, wherein the acquisition circumference areas are positioned with respect to each other with an equal circumferential separation of about 90°.

5. The compactor according to claim 1, wherein at least one contact sensor is provided in at least one acquisition circumference area on an interior position of a roller cover of the compactor roller.

6. The compactor according to claim 1, wherein at least one contact sensor is constructed as:

an acoustic sensor, a tactile sensor, or a pressure sensor.

7. The compactor according to claim 1, wherein a rotation positioning acquisition arrangement is provided to determine a rotational positioning of the compactor roller.

8. The compactor according to claim 7, wherein rotation positioning acquisition arrangement includes at least one contact sensor and at least one rotation positioning reference area not rotatable around the compactor roller rotation axis with the compactor roller, and appearing in an acquisition interplay with the at least one contact sensor.

9. The compactor according to claim 1, wherein the size of contact represents a circumference area of the compactor roller standing in contact with the substrate to be compacted.

10. The compactor according to claim 1, wherein at least one contact sensor is provided in each acquisition circumference area on an interior position of a roller cover of the compactor roller.

11. The compactor according to claim 1, wherein the at least one contact sensor is constructed as an ultrasound sensor or a whistle sensor.

12. The compactor according to claim 1, wherein the size of contact represents a circumference long area or an angular segment of the compactor roller standing in contact with the substrate to be compacted.

13. A process for determination of the size of contact representing a contact state of a compactor roller of a self-propelled compactor upon the substrate to be compacted, the process comprising the steps:

providing a self-propelled compactor, the compactor comprising a device to determine a size of contact representing a contact state between a compactor roller and a substrate to be compacted by the compactor, the device comprising:

the compactor roller, which is coupled to the compactor and rotatable in at least one acquisition circumference area around a compactor roller axis upon movement of the compactor in a direction; and at least one contact sensor generating a contact signal, wherein the contact signal indicates a contact start and a contact end of an acquisition circumference area upon the substrate to be compacted;

acquiring a contact between at least one acquisition circumference area of the compactor roller and the substrate to be compacted during the rotation of the compactor roller around a compactor roller rotation axis upon movement of the compactor in a direction; and determining the degree of compaction of the substrate on the basis of a size of the contact between the compactor roller and the substrate.

14. The process according to claim 13, wherein the size of contact is determined based on the start of contact occurring in the course of the rotation of the compactor roller between at least one acquisition circumference area and the substrate to be compacted and the end of contact.

15. The process according to claim 14, wherein the size of contact is determined based further on a movement speed of the compactor roller and/or a radius of the compactor roller.

16. The process according to claim 14, wherein the size of contact is determined based on a relationship between a first movement time indicating a contact of at least one acquisition circumference area with the substrate to be compacted, and a second movement time indicating no contact in the course of one revolution of the compactor roller around the compactor roller rotation axis and/or a second movement time indicating a revolution of the compactor roller.

17. The process according to claim 13, wherein the size of contact is composed of a first contact size portion between the start of contact of at least one acquisition circumference area upon the substrate to be compacted and a contact reference position, and a second contact size portion between the contact reference position and the end of contact.

18. The process according to claim 17, wherein the contact reference position represents the deepest positioning of the acquisition circumference area in the course of the revolution movement of one of the acquisition circumference areas with respect to a vertical line standing orthogonally to the substrate to be compacted, wherein the first contact size portion is a bow-side part of the size of contact and the second contact size portion is a rear-side part of the size of contact.

19. The process according to claim 17, wherein the contact reference position is determined based on at least one rotation positioning reference.

20. The process according to claim 19, wherein the rotation positioning reference is generated by the interplay of at least one acquisition circumference area with the rotation positioning reference area.

21. The process according to claim 20, wherein a first acquisition circumference area then generates a rotation positioning reference by interplay with a rotation positioning reference area, when a second acquisition circumference area is in the contact reference position.

22. The process according to claim 13, wherein the size of contact represents a circumferential area of the compactor roller standing in contact with the substrate to be compacted.

23. The process according to claim 13, wherein a contact width of the compactor roller on the substrate to be compacted is determined based on the size of contact.

24. The process according to claim 13, wherein the size of contact represents a circumferential long area or angle segment of the compactor roller standing in contact with the substrate to be compacted.

* * * * *